US007676322B1

(12) United States Patent
Kweon et al.

(10) Patent No.: US 7,676,322 B1
(45) Date of Patent: Mar. 9, 2010

(54) ENGINE CONTROL USING CYLINDER PRESSURE DIFFERENTIAL

(75) Inventors: Chol-Bum M Kweon, Rochester, MI (US); Frederic Anton Matekunas, Troy, MI (US); Paul Anthony Battiston, Clinton Township, MI (US)

(73) Assignee: GM Global Technology Operations, Inc.

( * ) Notice: Subject to any disclaimer, the term of this patent is extended or adjusted under 35 U.S.C. 154(b) by 0 days.

(21) Appl. No.: 12/367,935

(22) Filed: Feb. 9, 2009

Related U.S. Application Data

(60) Provisional application No. 61/089,995, filed on Aug. 19, 2008.

(51) Int. Cl.
*F02M 7/28* (2006.01)

(52) U.S. Cl. ..... 701/105; 701/108; 123/435

(58) Field of Classification Search ..... 123/435, 123/305; 701/105, 108
See application file for complete search history.

(56) References Cited

U.S. PATENT DOCUMENTS 4,621,603 A 11/1986 Matekunas
4,622,939 A 11/1986 Matekunas
4,624,229 A 11/1986 Matekunas
6,178,949 B1 * 1/2001 Kirwan et al. ..... 123/435
7,454,286 B2 * 11/2008 Sinnamon et al. ..... 701/110
2009/0005954 A1 * 1/2009 Sinnamon et al. ..... 701/102
2009/0254262 A1 * 10/2009 Kweon et al. ..... 701/104

OTHER PUBLICATIONS

SAE Technical Paper Series, Mark C. Sellnau, Frederic A. Matekunas, Paul A. Battiston, Chen-Fang Chang, and David R. Lancaster, *Cylinder-Pressure-Based Engine Control Using Pressure-Ratio-Management and Low-Cost Non-Intrusive Cylinder Pressure Sensors*,Copyright 2000, pp. 22, Mar. 6-9, 2000.

* cited by examiner

*Primary Examiner*—Hai H Huynh
(74) *Attorney, Agent, or Firm*—Harness, Dickey & Pierce, P.L.C.

(57) ABSTRACT

A combustion control system for a vehicle comprises a pressure ratio (PR) module, a pressure ratio difference (PRD) module, and a pressure ratio difference rate (PRDR) module. The PR module determines fired PR values and measured motored PR values based on cylinder pressures measured by a cylinder pressure sensor when a cylinder of an engine is fired and motored, respectively. The PRD module determines PRD values for predetermined crankshaft angles, wherein each of the PRD values is determined based on one of the fired PR values and one of the measured motored PR values at one of the predetermined crankshaft angles. The PRDR module determines and outputs a PRDR value based on a rate of change of the PRD values over a range of the predetermined crankshaft angles.

28 Claims, 8 Drawing Sheets

ENGINE CONTROL USING CYLINDER PRESSURE DIFFERENTIAL

CROSS-REFERENCE TO RELATED APPLICATIONS

This application claims the benefit of U.S. Provisional Application No. 61/089,995, filed on Aug. 19, 2008. The disclosure of the above application is incorporated herein by reference.

FIELD

The present disclosure relates to engine control systems and methods and more particularly to cylinder pressure.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Referring now to FIG. 1, a functional block diagram of an engine system 100 is presented. Air is drawn into an engine 102 through an intake manifold 104. A throttle valve 106 controls airflow into the engine 102. An electronic throttle controller (ETC) 108 controls the throttle valve 106 and, therefore, the airflow into the engine 102. The air mixes with fuel from one or more fuel injectors 110 to form an air/fuel mixture.

The air/fuel mixture is combusted within one or more cylinders of the engine 102, such as cylinder 112. Combustion of the air/fuel mixture may be initiated by, for example, injection of the fuel or spark provided by a spark plug 114. In spark ignition engine systems, a spark actuator module 116 controls the spark provided by the spark plug 114. Combustion of the air/fuel mixture produces torque and exhaust gas. More specifically, torque is generated via heat release and expansion during combustion of the air/fuel mixture within the cylinders. Torque is transferred by a crankshaft of the engine 102 through a driveline (not shown) to one or more wheels to propel a vehicle. The exhaust is expelled from the cylinders to an exhaust system 118.

An engine control module (ECM) 130 controls the torque output of the engine 102. The ECM 130 controls the torque output of the engine 102 based on driver inputs and/or other inputs. A driver input module 132 provides the driver inputs to the ECM 130. The other inputs include pressure signals ($Cyl_p$) from a cylinder pressure sensor 134 that measures pressure within the cylinder 112 (i.e., cylinder pressure).

The ECM 130 performs various computations based on the cylinder pressure. For example, the ECM 130 determines a pressure ratio for the cylinder 112 at various crankshaft angles. The pressure ratio is the ratio of the measured cylinder pressure at a crankshaft angle to a motored (ideal) cylinder pressure at that crankshaft angle. The motored cylinder pressure corresponds to an estimated cylinder pressure at the crankshaft angle if combustion did not occur within the cylinder 112. In other words, the motored cylinder pressure corresponds to an expected cylinder pressure at the crankshaft angle when the cylinder 112 is being motored. The motored cylinder pressure is computed based on an assumption that cylinder pressure changes as cylinder volume changes and that the cylinder pressure behaves polytropically based on the relationship below.

$$P(\Theta)=P_O[V_O/V(\Theta)]^{\gamma},$$

where P(Θ) is the cylinder pressure at a given crankshaft angle Θ, PO and VO are initial cylinder pressures and volumes, respectively, VΘ is the cylinder volume at the crankshaft angle Θ, and γ is a specific heat ratio.

The ECM 130 determines a heat release rate for the fuel injected, the quantity of fuel injected, and/or the cetane index (a measure of fuel ignitability). The ECM 130 may then adjust various parameters based on these measured and/or computed parameters, such as the timing of combustion. Combustion timing may be adjusted in a spark ignition engine via the spark timing and in a diesel engine via fuel injection timing. The ECM 130 may also adjust other parameters based on the parameters, such as the amount of fuel injected.

SUMMARY

A combustion control system for a vehicle comprises a pressure ratio (PR) module, a pressure ratio difference (PRD) module, and a pressure ratio difference rate (PRDR) module. The PR module determines fired PR values and measured motored PR values based on cylinder pressures measured by a cylinder pressure sensor when a cylinder of an engine is fired and motored, respectively. The PRD module determines PRD values for predetermined crankshaft angles, wherein each of the PRD values is determined based on one of the fired PR values and one of the measured motored PR values at one of the predetermined crankshaft angles. The PRDR module determines and outputs a PRDR value based on a rate of change of the PRD values over a range of the predetermined crankshaft angles.

In other features, the PRD module determines a first PRD value and a second PRD value for a first one and a second one of the predetermined crankshaft angles, respectively, wherein the PRDR module determines the PRDR value based on a difference between the first and second PRD values, and wherein the range is defined by the first and second ones of the predetermined crankshaft angles.

In still other features, the combustion control system further comprises a heat release profile module. The heat release profile module determines a heat release profile for fuel provided to the cylinder based on the PRDR value.

In further features, the combustion control system of claim 3 further comprises a timing control module. The timing control module adjusts a combustion timing for the cylinder based on the heat release profile.

In still further features, the combustion timing comprises a fuel injection timing.

In other features, the PRDR module determines the PRDR value further based on a combustion timing and an EGR valve opening.

In still other features, the combustion control system further comprises at least one of a pressure ratio difference average (PRDA) module and an indicated mean effective pressure difference (IMEPD) module. The PRDA module that determines a PRDA value based on an average of a number of the PRD values. The IMEPD module determines an IMEPD value based on a fired indicated mean effective pressure (IMEP) value and a motored IMEP value for the cylinder.

In further features, the combustion control system further comprises a diagnostic module. The diagnostic module diagnoses at least one of a quantity of fuel provided to the cylinder, a cetane number (CN) for the fuel, and a crankshaft angle at which a predetermined amount of the fuel was combusted within the cylinder based on at least one of the PRDA value and the IMEPD value.

A combustion control system for a vehicle comprises an indicated mean effective pressure (IMEP) module and an indicated mean effective pressure difference (IMEPD) module. The IMEP module determines fired IMEP values and motored IMEP values based on cylinder pressures measured by a cylinder pressure sensor when a cylinder of an engine is fired and motored, respectively. The IMEPD module determines and outputs an IMEPD value based on a difference between one of the fired IMEP values and one of the motored IMEP values.

In further features, the combustion control system further comprises a diagnostic module. The diagnostic module diagnoses at least one of a quantity of fuel provided to the cylinder, a cetane number (CN) for the fuel, and a crankshaft angle at which a predetermined amount of the fuel was combusted within the cylinder based on the IMEPD value.

In still further features, the combustion control system further comprises a pressure ratio (PR) module, a pressure ratio difference (PRD) module, and a pressure ratio difference rate (PRDR) module. The PR module determines fired PR values and measured motored PR values based on the cylinder pressures. The PRD module determines PRD values for predetermined crankshaft angles, wherein each of the PRD values is determined based on one of the fired PR values and one of the measured motored PR values at one of the predetermined crankshaft angles. The PRDR module determines and outputs a PRDR value based on a rate of change of the PRD values over a range of the predetermined crankshaft angles.

In other features, the PRD module determines a first PRD value and a second PRD value for a first one and second one of the predetermined crankshaft angles, respectively, wherein the PRDR module determines the PRDR value based on a difference between the first and second PRDs, and wherein the range is defined by the first and second ones of the predetermined crankshaft angles.

In still other features, the combustion control system further comprises a heat release profile module. The heat release profile module determines a heat release profile for fuel provided to the cylinder based on the PRDR value.

In further features, the combustion control system further comprises a timing control module. The timing control module adjusts a combustion timing for the cylinder based on the heat release profile.

A method for a vehicle comprises: determining fired pressure ratio (PR) values and measured motored PR values based on cylinder pressures measured by a cylinder pressure sensor when a cylinder of an engine is fired and motored, respectively; determining pressure ratio difference (PRD) values for predetermined crankshaft angles, wherein each of the PRD values is determined based on one of the fired PR values and one of the measured motored PR values at one of the predetermined crankshaft angles; determining a pressure ratio difference rate (PRDR) value based on a rate of change of the PRD values over a range of the predetermined crankshaft angles; and outputting the PRDR value.

In other features, the determining the PRD values comprises determining a first PRD value and a second PRD value for a first one and a second one of the predetermined crankshaft angles, respectively, wherein the determining the PRDR value comprises determining the PRDR value based on a difference between the first and second PRD values, and wherein the range is defined by the first and second ones of the predetermined crankshaft angles.

In further features, the method further comprises determining a heat release profile for fuel provided to the cylinder based on the PRDR value.

In still further features, the method further comprises adjusting a combustion timing for the cylinder based on the heat release profile.

In other features, the adjusting the combustion timing comprises adjusting a fuel injection timing.

In still other features, the determining the PRDR value comprises determining the PRDR value further based on a combustion timing and an EGR valve opening.

In further features, the method comprises at least one of: determining a pressure ratio difference average (PRDA) value based on an average of a number of the PRD values; and determining an indicated mean effective pressure difference (IMEPD) value based on a fired indicated mean effective pressure (IMEP) value and a motored IMEP value for the cylinder.

In still further features, the method further comprises diagnosing at least one of a quantity of fuel provided to the cylinder, a cetane number (CN) for the fuel, and a crankshaft angle at which a predetermined amount of the fuel was combusted within the cylinder based on at least one of the PRDA value and the IMEPD value.

A method for a vehicle comprises determining fired indicated mean effective pressure (IMEP) values and motored IMEP values based on cylinder pressures measured by a cylinder pressure sensor when a cylinder of an engine is fired and motored, respectively, and determining an indicated mean effective pressure difference (IMEPD) value based on a difference between one of the fired IMEP values and one of the motored IMEP values.

In further features, the method further comprises diagnosing at least one of a quantity of fuel provided to the cylinder, a cetane number (CN) for the fuel, and a crankshaft angle at which a predetermined amount of the fuel was combusted within the cylinder based on the IMEPD value.

In still further features, the method further comprises: determining fired pressure ratio (PR) values and measured motored PR values based on the cylinder pressures; determining pressure ratio difference (PRD) values for predetermined crankshaft angles, wherein each of the PRD values is determined based on one of the fired PR values and one of the measured motored PR values at one of the predetermined crankshaft angles; determining a pressure ratio difference rate (PRDR) value based on a rate of change of the PRD values over a range of the predetermined crankshaft angles; and outputting the PRDR value.

In other features, the determining the PRD values comprises determining a first PRD value and a second PRD value for a first one and a second one of the predetermined crankshaft angles, respectively, wherein the determining the PRDR value comprises determining the PRDR value based on a difference between the first and second PRD values, and wherein the range is defined by the first and second ones of the predetermined crankshaft angles.

In further features, the method further comprises determining a heat release profile for fuel provided to the cylinder based on the PRDR value.

In still further features, the method further comprises adjusting a combustion timing for the cylinder based on the heat release profile.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
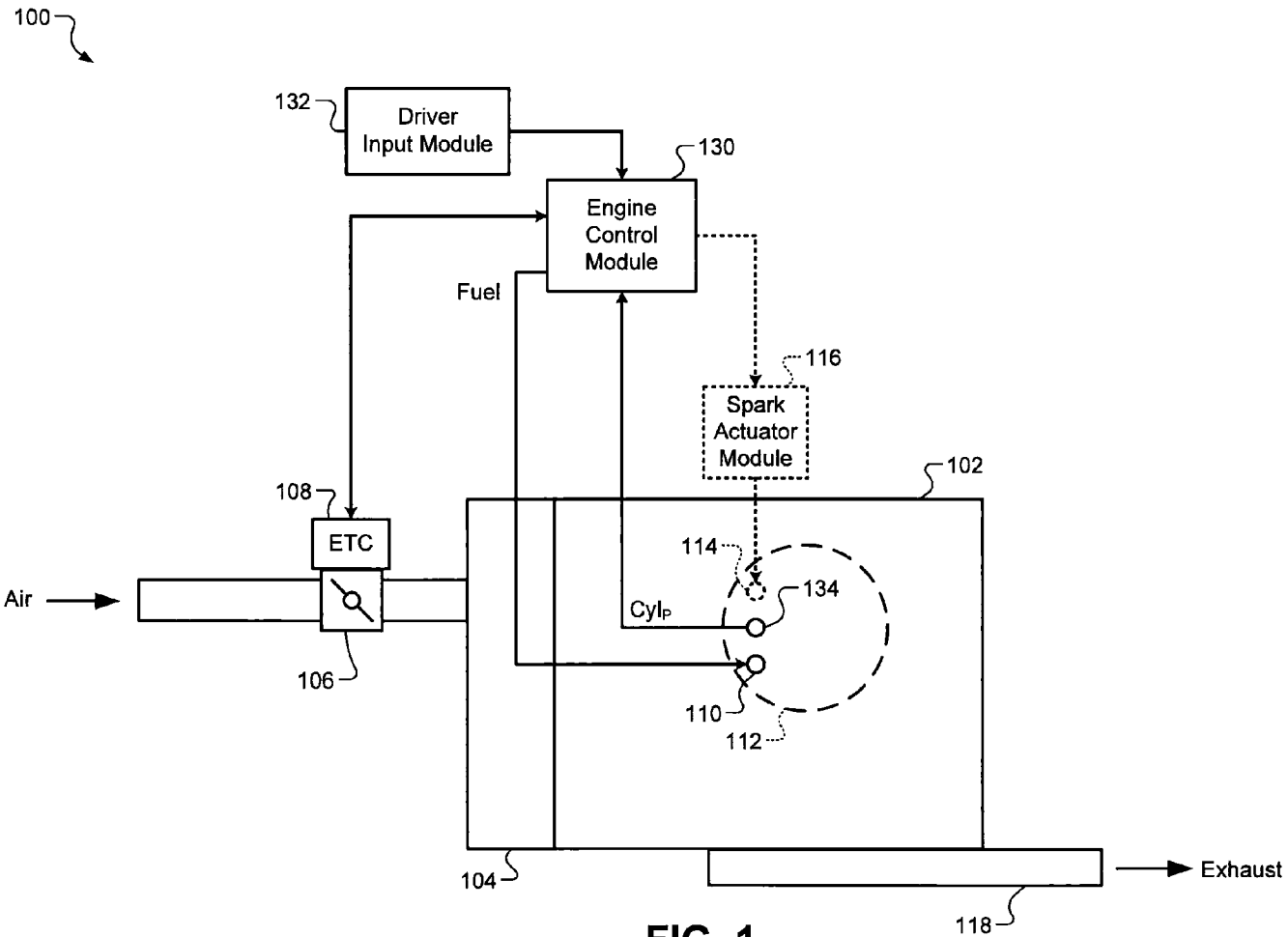
FIG. 1 Prior Art
FIG. 1 is a functional block diagram of an engine system according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A combustion control system according to the principles of the present application determines pressure ratio (PR) values based on cylinder pressures measured by a cylinder pressure sensor. The cylinder pressure sensor measures pressure within a cylinder of an engine. The combustion control system determines fired PR values at predetermined crankshaft angles when the cylinder is fired. The combustion control system also determines motored PR values at the predetermined crankshaft angles when the cylinder is motored (i.e., not fired).

The combustion control system determines pressure ratio difference (PRD) values for the predetermined crankshaft angles based on the fired and measured motored PR values. More specifically, a PRD value for one of the predetermined crankshaft angles is determined based on a fired PR value and a measured motored PR value at that crankshaft angle.

The combustion control system determines a pressure ratio difference rate (PRDR) value based on a rate of change of the PRD values over a range of the predetermined crankshaft angles. The combustion control system uses the PRDR to determine, for example, a heat release profile for fuel provided to the cylinder when the cylinder was fired.

The combustion control system may also determine a pressure ratio difference average (PRDA) value and/or an indicated mean effective pressure difference (IMEPD) value. The combustion control system determines the PRDA value based on an average of a number of the PRD values. The combustion control system determines the IMEPD value based on a fired indicated mean effective pressure (IMEP) value and a motored IMEP value when the cylinder was fired and motored, respectively.

The combustion control system may determine one or more combustion parameters based on the PRDA value and/or the IMEPD value. For example only, based on the PRDA value and/or the IMEPD value, the combustion control system may determine a quantity of the fuel provided to the cylinder and/or a cetane number (CN) for the fuel. Additionally, the combustion control system may determine a crankshaft angle at which a predetermined percentage or mass of the fuel was combusted based on the PRDA value and/or the IMEPD value.

Figure 2:
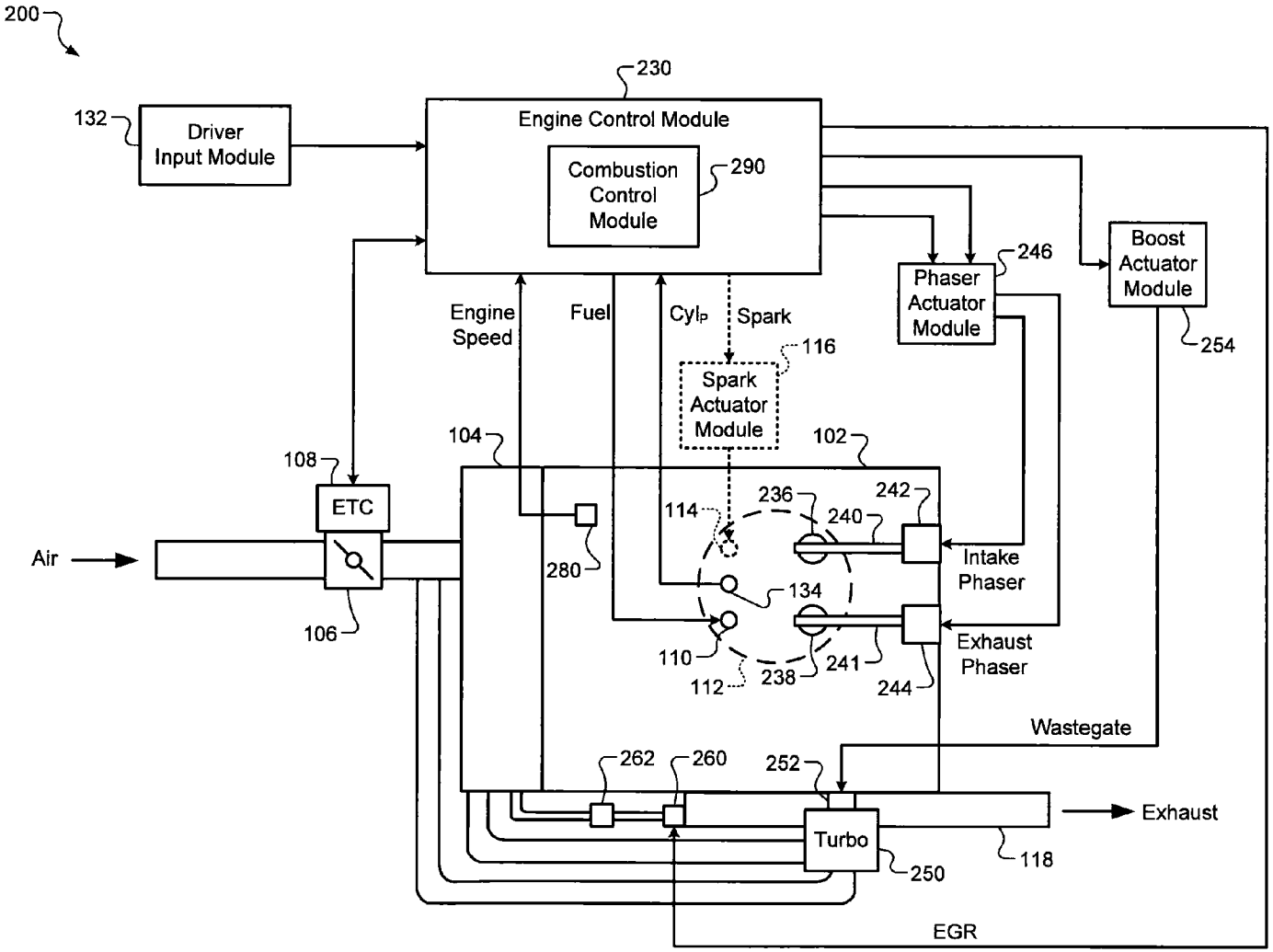
FIG. 2 is a functional block diagram of an exemplary engine system according to the principles of the present disclosure.

Referring now to FIG. 2, a functional block diagram of an exemplary engine system 200 is presented. The engine system 200 includes the engine 102 that combusts an air/fuel mixture to produce drive torque. Air is drawn into the intake manifold 104 through the throttle valve 106. The ETC 108 controls opening of the throttle valve 106 and, therefore, airflow into the engine 102.

Air from the intake manifold 104 is drawn into cylinders of the engine 102. While the engine 102 may include multiple cylinders, for illustration purposes only, only the single representative cylinder 112 is shown. For example only, the engine 102 may include 2, 3, 4, 5, 6, 8, 10, and/or 12 cylinders.

Air from the intake manifold 104 is drawn into the cylinder 112 through an associated intake valve 236. An engine control module (ECM) 230 controls the amount of fuel injected by the fuel injector 110 and the timing of the injection of fuel. The fuel injector 110 may inject fuel into the intake manifold 104 at a central location or may inject fuel into the intake manifold 104 at multiple locations, such as near the intake valve of each of the cylinders. Alternatively, the fuel injector 110 may inject fuel directly into the cylinder 112 as shown in FIG. 2.

The injected fuel mixes with the air and creates the air/fuel mixture in the cylinder 112. A piston (not shown) within the cylinder 112 compresses the air/fuel mixture. Based upon a signal from the ECM 230, the spark actuator module 116 energizes the spark plug 114 associated with the cylinder 112, which initiates combustion of the air/fuel mixture.

In other engine systems, the spark plug 114 may not be necessary to initiate combustion. For example only, in diesel engine systems, heat produced through compression of air within the cylinder 112 initiates combustion when the fuel is injected into the cylinder 112. In other words, the injection of fuel initiates combustion in diesel engine systems. The ECM 230 controls timing of the injection of fuel and, therefore, controls the initiation of combustion. The time at which combustion is initiated may be specified relative to the time when the piston is at its topmost position, referred to as to top dead center (TDC), the point at which the air/fuel mixture is most compressed.

The combustion of the air/fuel mixture drives the piston down, thereby rotatably driving a crankshaft (not shown). The piston drives the crankshaft until the piston is at its bottommost position, referred to as to bottom dead center (BDC). The piston then begins moving up again and expels the byproducts of combustion through an associated exhaust valve 238. The byproducts of combustion are exhausted from the vehicle via the exhaust system 118.

The intake valve 236 is controlled by an intake camshaft 240, and the exhaust valve 238 is controlled by an exhaust camshaft 241. In other implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders.

An intake cam phaser 242 controls the intake camshaft 240 and, therefore, controls the time at which the intake valve 236 is opened. Similarly, an exhaust cam phaser 244 controls the intake camshaft 240 and, therefore, controls the time at which the exhaust valve 238 is opened. The timing of the opening of the intake and exhaust valves 236 and 238 may be specified relative to, for example, piston TDC or piston BDC. A phaser actuator module 246 controls the intake cam phaser 242 and the exhaust cam phaser 244 based on signals from the ECM 230.

The engine system 200 may also include a boost device that provides pressurized air to the intake manifold 104. For example only, FIG. 2 depicts a turbocharger 250. The turbocharger 250 is powered by exhaust gases flowing through the exhaust system 118, and provides a compressed air charge to the intake manifold 104.

A wastegate 252 selectively allows exhaust gas to bypass the turbocharger 250, thereby reducing the turbocharger's output (or boost). The ECM 230 controls the turbocharger 250 via a boost actuator module 254. The boost actuator module 254 may modulate the boost of the turbocharger 250 by controlling the position of the wastegate 252.

An intercooler (not shown) may be implemented to dissipate some of the compressed air charge's heat. This heat may be generated when air is compressed and may also include heat from the exhaust system 118. Alternate engine systems may include a supercharger that provides compressed air to the intake manifold 104 and is driven by the crankshaft.

The engine system 200 may also include an exhaust gas recirculation (EGR) valve 260, which selectively redirects exhaust gas back to the intake manifold 104. While the EGR valve 260 is shown in FIG. 2 as being located upstream of the turbocharger 250, the EGR valve 260 may be located downstream of the turbocharger 250. An EGR cooler 262 may also be implemented to cool the redirected exhaust gas before the exhaust gas is provided to the intake manifold 104.

The ECM 230 regulates the torque output of the engine 102 based on driver inputs provided by the driver input module 132 and inputs provided by various sensors. For example only, the ECM 230 receives a signal corresponding to the rotational speed of the crankshaft in revolutions per minute (rpm) using an engine speed sensor 280.

The engine speed sensor 280 may include a variable reluctance (VR) sensor or any other suitable type of engine speed sensor. The engine speed signal may include a pulse train. Each pulse of the pulse train may be generated as a tooth of an N-toothed wheel (not shown) that rotates with the crankshaft, passes the VR sensor. Accordingly, each pulse corresponds to an angular rotation of the crankshaft by an amount equal to 360° divided by N teeth. The N-toothed wheel may also include a gap of one or more missing teeth.

The ECM 230 receives signals from other sensors, such as an engine coolant temperature sensor, a manifold absolute pressure (MAP) sensor, a mass air flow (MAF) sensor, a throttle position sensor, an intake air temperature (IAT) sensor, and/or any other suitable sensor. The ECM 230 also receives signals from the cylinder pressure sensor 134.

The cylinder pressure sensor 134 measures pressure within the cylinder 112 and generates cylinder pressure signals ($Cyl_p$) accordingly. While only the single representative cylinder pressure sensor 134 is shown, the engine system 200 may include any suitable number of cylinder pressure sensors. For example only, one or more cylinder pressure sensors may be provided for each cylinder of the engine 102.

The engine system 200 includes a combustion control module 290 according to the principles of the present disclosure. While the combustion control module 290 is shown as being located within the ECM 230, the combustion control module 290 may be located in any suitable location. For example only, the combustion control module 290 may be located external to the ECM 230.

Figure 3:
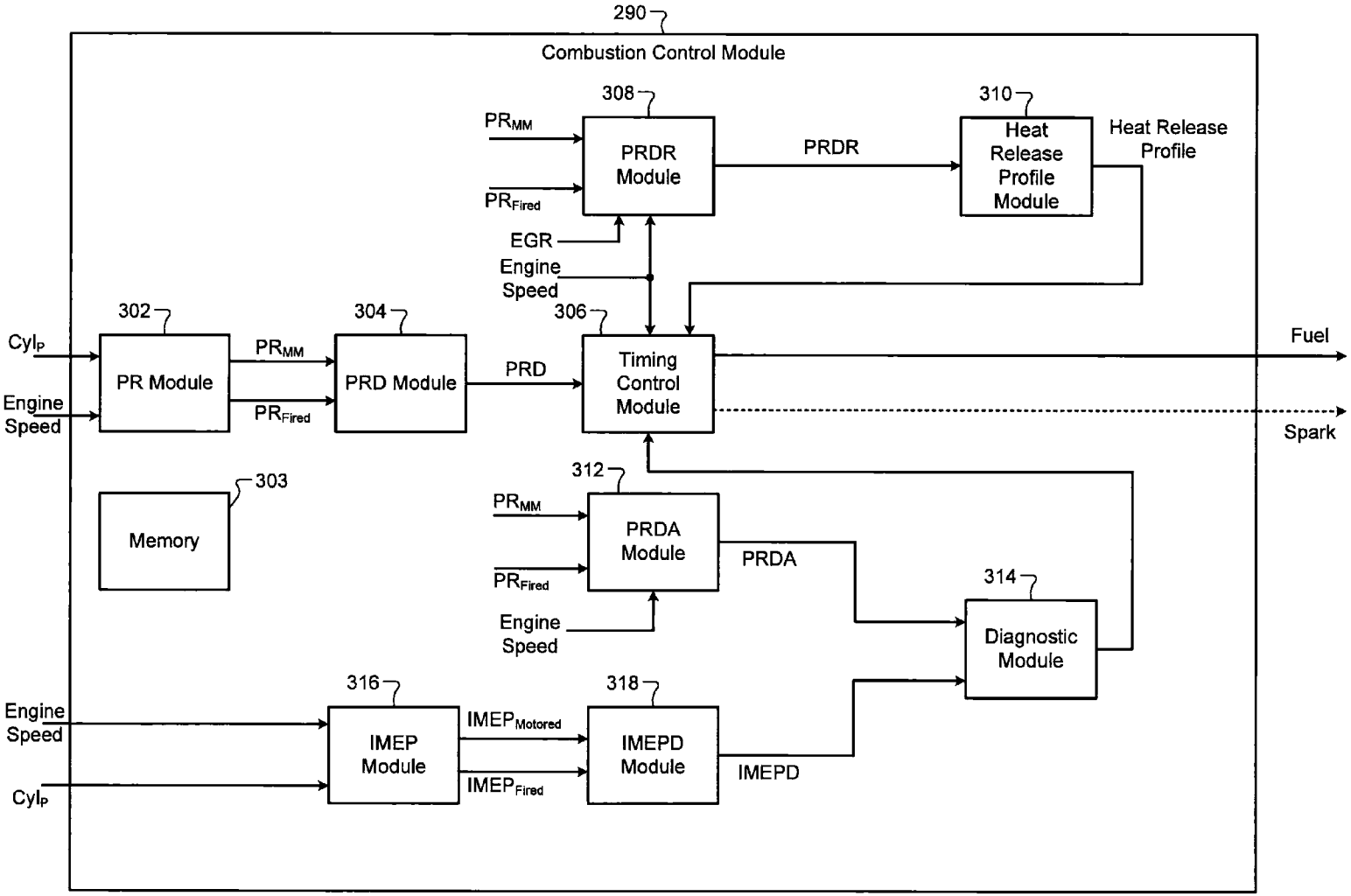
FIG. 3 is functional block diagram of an exemplary combustion control module according to the principles of the present disclosure.

Referring now to FIG. 3, a functional block diagram of an exemplary implementation of the combustion control module 290 is presented. The combustion control module 290 includes a pressure ratio (PR) module 302, a pressure ratio difference (PRD) module 304, and a timing control module 306. The combustion control module 290 also includes a pressure ratio difference rate (PRDR) module 308 and a heat release profile module 310. Additionally, the combustion control module 290 includes a pressure ratio difference average (PRDA) module 312, a diagnostic module 314, an indicated mean effective pressure (IMEP) module 316, and an indicated mean effective pressure difference (IMEPD) module 318.

The PR module 302 determines a pressure ratio (PR) at given crankshaft angles, or crankshaft angle degrees (CADs). The PR at a crankshaft angle is equal to the measured cylinder pressure ($P_{measured}$) at the crankshaft angle divided by a motored cylinder pressure ($P_{motored}$) at the crankshaft angle. The measured cylinder pressure is provided by the cylinder pressure sensor 134.

The motored cylinder pressure corresponds to an expected cylinder pressure at the crankshaft angle when combustion is not occurring (i.e., when the cylinder 112 is not being fired). The motored cylinder pressure may be obtained from a lookup table or determined theoretically. For example only, the motored cylinder pressure may be retrieved from a lookup table based on the crankshaft angle. The motored cylinder pressure may be determined theoretically using, for example, the equations:

$$P_{motored}=P_1*(V_1/V)^{\gamma}=P_1*CR^{\gamma}, \quad (1)$$

where $P_1$ is a previous cylinder pressure, $V_1$ is a previous volume of the cylinder 112, V is the current volume of the cylinder 112, CR is a compression ratio, and $\gamma$ is a specific heat ratio.

Figure 4:
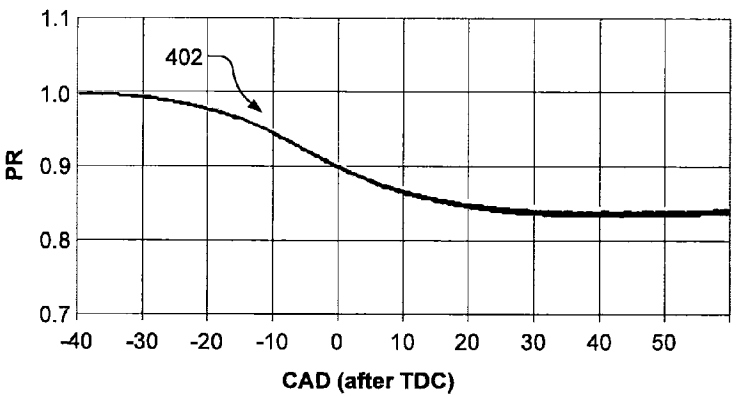
FIG. 4 is an exemplary illustration of motored cylinder pressure ratios versus crankshaft angle according to the principles of the present disclosure.

The volumes of the cylinder 112 may be determined based on the crankshaft angle. The specific heat ratio may be a constant, such as 1.365 for a diesel engine system or 1.32 for a gasoline engine system. In other implementations, the specific heat ratio may be determined from a lookup table of specific heat ratios indexed by crankshaft angle. The values of the lookup table may include motored cylinder pressures stored based on exemplary motored cylinder traces 402 of FIG. 4.

Specifically, the PR module 302 determines two PRs for the crankshaft angle: a first PR for when the cylinder 112 is fired and a second PR for when the cylinder 112 is motored (i.e., not fired). A PR determined when the cylinder 112 is fired is referred to as a fired PR (i.e., $PR_{Fired}$), and a PR determined when the cylinder 112 is motored is referred to as a measured motored PR (i.e., $PR_{MM}$). The cylinder 112 may switched between being fired and motored on consecutive engine cycles, which is referred to as skip firing. The cylinder 112 may be skip-fired during predetermined events, such as during deceleration overruns and/or idling.

The PRD module 304 determines a pressure ratio difference (PRD) for the crankshaft angle based on the fired PR and the measured motored PR at the crankshaft angle. For example only, the PRD module 304 may determine the PRD for the crankshaft angle using the equation:

$$PRD(\Theta)=PR_{Fired}(\Theta)-PR_{MM}(\Theta), \quad (2)$$

where $\Theta$ is the crankshaft angle, $PR_{Fired}$ is the fired PR at the crankshaft angle, and $PR_{MM}$ is the measured motored PR at the crankshaft angle. The PRD module 304 may also normalize the PRD by dividing the PRD by the PRD at 90° after TDC. Additionally, the PRD module 304 may store the PRD in a predetermined location, such as in memory 303.

The timing control module 306 selectively adjusts various combustion parameters based on the PRD. For example only, the timing control module 306 may adjust the timing of the initiation of combustion (i.e., the combustion timing) based on the PRD. The combustion timing may be adjusted in any suitable manner, such as by adjusting the spark timing in gasoline engine systems or the timing of the injection of fuel in diesel engine systems.

Adjusting the timing of combustion adjusts, for example, the crankshaft angle at which various percentages of the injected fuel are combusted (e.g., 10% and/or 50%). Adjusting the combustion timing also adjusts the crankshaft angle at which various amounts of the mass of the injected fuel is burned, which is referred to as the mass burned fraction (MBF).

Figure 5:
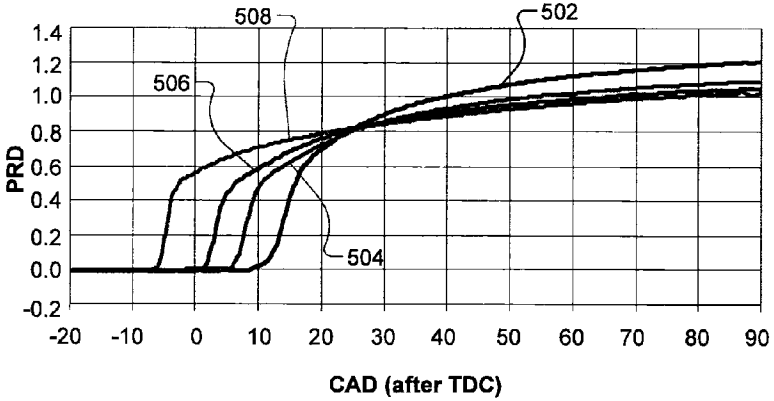
FIGS. 5-7 are an exemplary illustrations of various pressure ratio differences (PRDs) versus crankshaft angle according to the principles of the present disclosure.

Referring now to FIG. 5, an exemplary illustration of various PRDs versus crankshaft angle is presented. PRD traces 502, 504, 506, and 508 correspond to PRDs when combustion is initiated at 1° after TDC, 3° before TDC, 7° before TDC, and 15° before TDC, respectively. The PRD traces 502, 504, 506, and 508 were determined with an engine speed of 1400 rpm, a braking mean effective pressure (BMEP) of 5.0 bar, and an EGR opening of 54%. Accordingly, the timing control module 306 may adjust the combustion timing based on the PRD and thereby cause a desired percentage (or mass) of the injected fuel to be combusted at a desired crankshaft angle.

Figure 6:
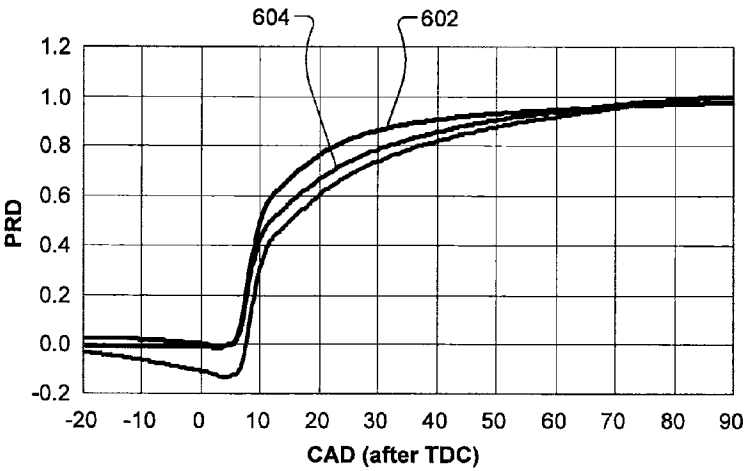

Referring now to FIG. 6, an exemplary illustration of the relationship between MBF and PRD is presented. Trace 602 corresponds to an exemplary MBF, and trace 604 corresponds to an exemplary normalized PRD. The MBF trace 602 and the normalized PRD trace 604 were determined based on an engine speed of 1400 rpm, a BMEP of 5.0 bar, an EGR opening of 54%, and a combustion timing (e.g., fuel injection) of 3° before TDC. The normalized PRD trace 604 closely tracks the MBF trace 602, as shown in FIG. 6. Thus, the timing control module 306 may also use the PRD for determining the MBF.

Figure 7:
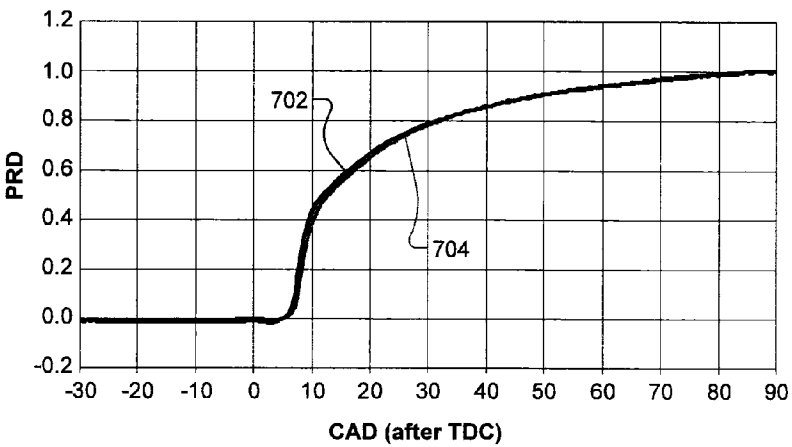

Referring now to FIG. 7, an exemplary illustration of the relationship between normalized PRD and PRD divided by the motored PR is presented. Trace 702 corresponds to an exemplary normalized PRD, and trace 704 corresponds to an exemplary PRD divided by the motored PR. The trace 704 closely tracks the normalized PRD trace 702, as shown in FIG. 7. The PRD divided by the motored PR may therefore be used as an alternative to normalized PRD and/or MBF.

Referring back to FIG. 3, the PRDR module 308 determines a pressure ratio difference rate (PRDR) based on the difference between the measured motored PR and the fired PR over a range of crankshaft angles. More specifically, the PRDR module 308 determines the PRDR based on a change in the difference between the measured and motored PRs over the range of crankshaft angles. In other words, the PRDR module 308 determines the PRDR based on a change in the PRD over the range of crankshaft angles. For example only, the PRDR module 308 determines the PRDR using the differential equation:

$$PRDR(\Theta)=d(PR_{Fired}(\Theta)-PR_{MM}(\Theta))/d\Theta, \quad (3)$$

where $\Theta$ is the crankshaft angle range, $PRDR(\Theta)$ is the PRDR for that crankshaft angle range. In other implementations, the PRDR module 308 may determine the PRDR using the equation:

$$PRDR = \frac{[PR_{Fired}(\Theta_1) - PR_{MM}(\Theta_1) - PR_{Fired}(\Theta_2) - PR_{MM}(\Theta_2)]}{(\Theta_1 - \Theta_2)}, \quad (4)$$

where $\Theta_1$ is a first crankshaft angle of the crankshaft angle range and $\Theta_2$ is a second crankshaft angle of the crankshaft angle range.

The heat release profile module 310 determines a heat release profile for the injected fuel based on the PRDR. The heat release profile tracks heat released via combustion of the injected fuel. A heat release rate (HRR) can be determined based on the heat release profile, which the timing control module 306 and/or one or more other modules may use in adjusting the combustion timing, adjusting the amount of fuel injected, and/or determining characteristics of fuel injected (e.g., amount of cetane). The heat release profile module 310 may also detect various other parameters based on the PRDR, such as fuel evaporation after injection, the peak of heat release, the start of combustion, the combustion duration, and/or the end of combustion.

Figure 8:
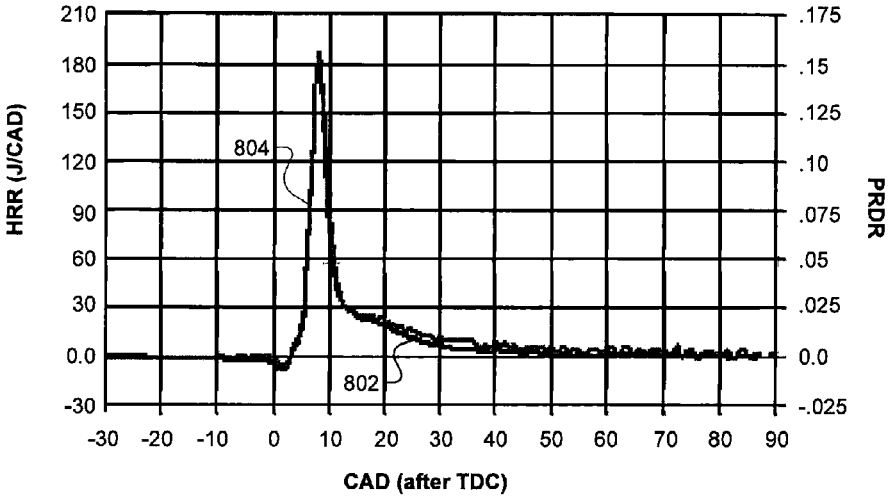
FIG. 8 is an exemplary illustration of a heat release profile and a pressure ratio difference rate (PRDR) versus crankshaft angle according to the principles of the present disclosure.

Referring now to FIG. 8, an exemplary illustration of the relationship between heat release rate (HRR) and PRDR is presented. Trace 802 corresponds to an exemplary heat release rate, and trace 804 corresponds to an exemplary PRDR. The PRDR trace 804 closely tracks the heat release rate trace 802, as shown in FIG. 8. Thus, the PRDR may be used as an indicator of the heat release rate.

Figure 9:
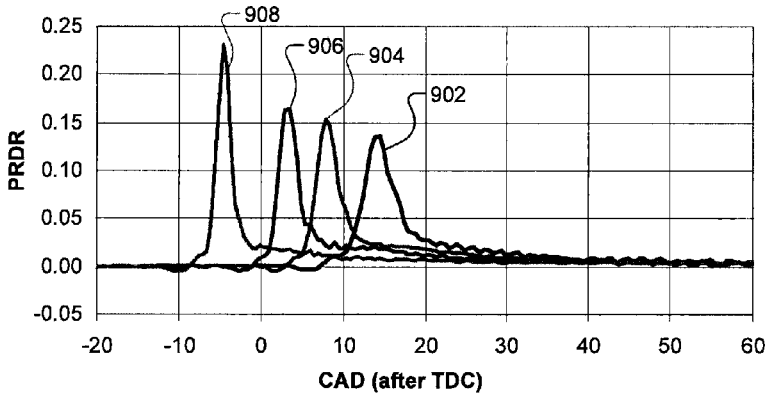
FIG. 9 is an exemplary illustration of PRDRs versus crankshaft angle with various combustion timings according to the principles of the present disclosure.

Referring back to FIG. 3, the PRDR module 308 also determines the PRDR based on other parameters, such as the EGR opening and the combustion timing. Referring now to FIG. 9, an exemplary illustration of various PRDRs at different combustion timings is presented. PRDR traces 902, 904, 906, and 908 correspond to when combustion is initiated at 1° after TDC, 3° before TDC, 7° before TDC, and 15° before TDC, respectively. The PRDR traces 902, 904, 906, and 908 were determined with an engine speed of 1400 rpm, a BMEP of 5.0 bar, and an EGR opening of 54%. As shown in FIG. 9, the PRDR varies with combustion timing. Accordingly, the PRDR module 308 may determine the PRDR based on the combustion timing.

Figure 10:
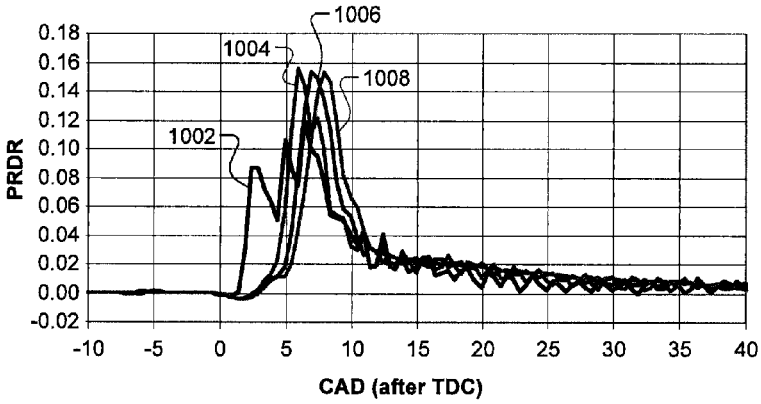
FIG. 10 is an exemplary illustration of PRDRs versus crankshaft angle with various exhaust gas recirculation (EGR) valve openings according to the principles of the present disclosure.

Referring now to FIG. 10, an exemplary illustration of various PRDRs at different EGR valve openings is presented. PRDR traces 1002, 1004, 1006, and 1008 correspond to when the EGR valve opening is 0.0%, 49.0%, 51.0%, and 54.0%, respectively. The PRDR traces 1002, 1004, 1006, and 1008 were determined with an engine speed of 1400 rpm, a braking mean effective pressure of 5 bar, and a combustion timing (e.g., fuel injection timing) of 3° before TDC. As shown in FIG. 10, the PRDR varies with the EGR valve opening. Accordingly, the PRDR module 308 may determine the PRDR based on the EGR valve opening.

Referring back to FIG. 3, the PRDA module 312 determines a pressure ratio difference average (PRDA) based on an average of a number of differences between fired and measured motored PRs. The PRDA corresponds to an average of the difference between the fired PR and the measured motored PR over a predetermined number of samples. More specifically, the PRDA module 312 determines the PRDA based on a sum of the number of PRDs divided by the number of PRDs. For example only, the PRDA module 312 may determine the PRDA using the equation:

$$PRDA = \sum_{1}^{N} \frac{(PR_{Fired}(\Theta) - PR_{MM}(\Theta))}{N}, \tag{5}$$

where N is the number of PRD samples and Θ is a crankshaft angle for which a PRD sample is determined. N is an integer greater than 1.

The diagnostic module 314 diagnoses various combustion parameters based on the PRDA. The diagnostic module 314 may use the PRDA to diagnose, for example, the quantity of fuel injected, cetane number (CN) of the injected fuel, and/or the crankshaft angle at which a predetermined percentage (or mass) of the injected fuel has been combusted (e.g., 10% and/or 50%). The CN of an injected fuel is a measurement of the combustion quality (e.g., ignitability) of that fuel. In particular, the CN of a fuel affects the ignition delay of that fuel (i.e., the period of time between the injection of the fuel and the start of combustion). Fuels having higher CNs tend to have shorter ignition delays than fuels with lower CNs.

Figure 11A:
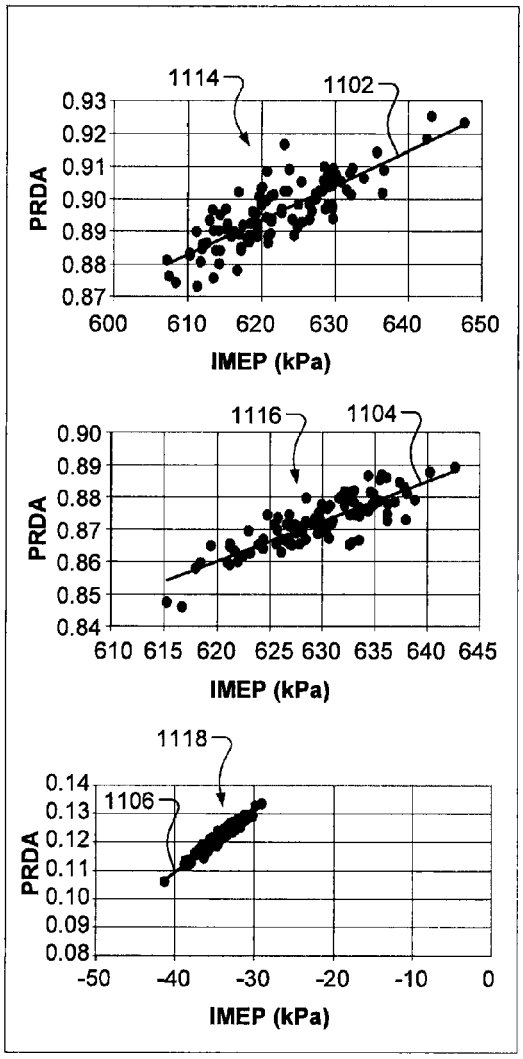
FIGS. 11A-11B are exemplary illustrations of pressure ratio difference average (PRDA) and dilution parameter (DilPar), respectively, versus indicated mean effective pressure (IMEP) according to the principles of the present disclosure.
Figure 11B:
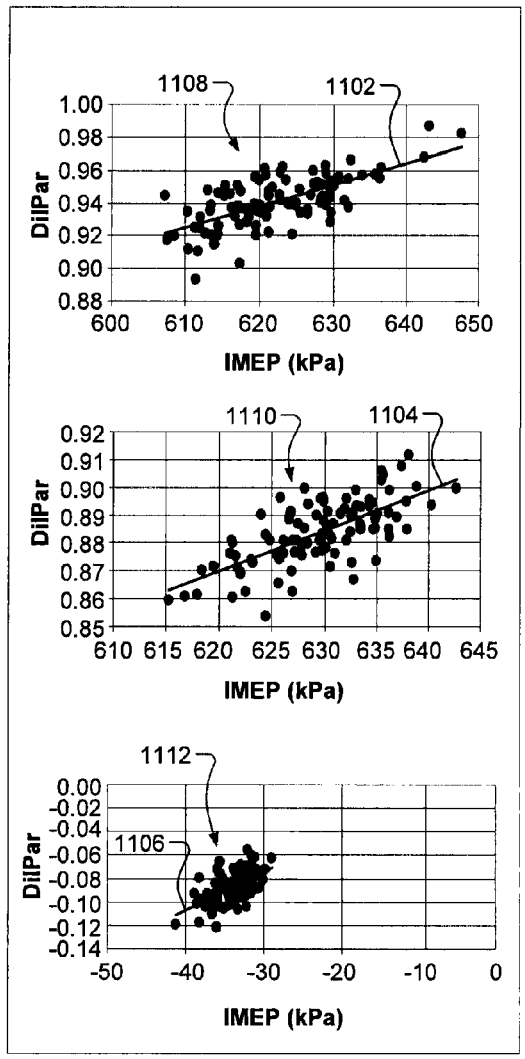

FIG. 11A depicts the relationship between PRDA and indicated mean effective pressure (IMEP). FIG. 11B depicts the relationship between a dilution parameter (DilPar) and IMEP. The dilution parameter is a parameter that is also used to diagnose the quantity of fuel injected. Baselines 1102, 1104, and 1106 represent theoretical values when a known quantity of fuel is injected.

DilPar values 1108, 1110, and 1112 correspond to dilution parameter values determined based on the IMEP when the known quantity of fuel is injected. Correlation coefficients ($R^2$) for the DilPar values 1108, 1110, and 1112 are 0.4409, 0.4734, and 0.3398, respectively. The correlation coefficients correspond to the relative accuracy of the values. For example only, accuracy increases as the correlation coefficient approaches 1.0.

PRDA values 1114, 1116, and 1118 of FIG. 11A represent exemplary PRDA values determined based on the PRs measured by the cylinder pressure sensor 134 according to the principles of the present disclosure. The correlation coefficients ($R^2$) for the PRDA values 1114, 1116, and 1118 are 0.6749, 0.7201, and 0.9488 respectively.

The correlation coefficients of the PRDA values 1114, 1116, and 1118 are closer to 1.0 than the correlation coefficients of the DilPar values 1108, 1110, and 1112. PRDA may therefore be a more accurate measure of the quantity of fuel injected than DilPar. Accordingly, the diagnostic module 314 may diagnose the quantity of fuel injected based on the PRDA. The diagnostic module 314 may use the quantity of fuel injected to, for example, diagnose aging of the fuel injector 110.

The IMEP module 316 determines indicated mean effective pressures (IMEPs). The IMEP corresponds to the average of the measured cylinder pressure during a cylinder cycle. The IMEP module 316 outputs an IMEP when the cylinder 112 is fired and an IMEP when the cylinder 112 is motored. The IMEP for the cylinder 112 when the cylinder 112 is fired is referred to as a fired IMEP (i.e., $IMEP_{Fired}$), and the IMEP when the cylinder 112 is motored is referred to as a motored IMEP (i.e., $IMEP_{Motored}$).

The IMEP module 316 determines the IMEPs based on the cylinder pressure at various crankshaft angles. For example only, the IMEP module may determine the IMEPs using the equation:

$$IMEP = \frac{W}{V}, \tag{6}$$

where W is the work done on the piston, and V is the volume of the cylinder 112. The volume of the cylinder 112 may be determined based on the crankshaft angle and known parameters, such as the maximum volume of the cylinder 112 (i.e., when piston is at BDC) and the piston position within the cylinder 112. The work done on the piston may be determined, for example, using the equation:

$$W = \int P * dV, \tag{7}$$

where P is the cylinder pressure.

The IMEPD module 318 determines and outputs an indicated mean effective pressure difference (IMEPD) based on the difference between the fired IMEP and the motored IMEP. For example only the IMEPD module 318 may determine the IMEPD using the equation:

$$IMEPD = IMEP_{Fired} - IMEP_{Motored}, \tag{8}$$

where $IMEP_{Fired}$ is the fired IMEP, and $IMEP_{Motored}$ is the motored IMEP.

As stated above, the diagnostic module 314 diagnoses various combustion parameters based on the PRDA. The diagnostic module 314, however, may use the IMEPD as an alternative to the PRDA. In other words, the diagnostic module 314 may use the IMEPD to diagnose, for example, the quantity of fuel injected and/or the crankshaft timing at which a predetermined percentage of the injected fuel has been combusted (e.g., 10% and/or 50%).

Figure 12A:
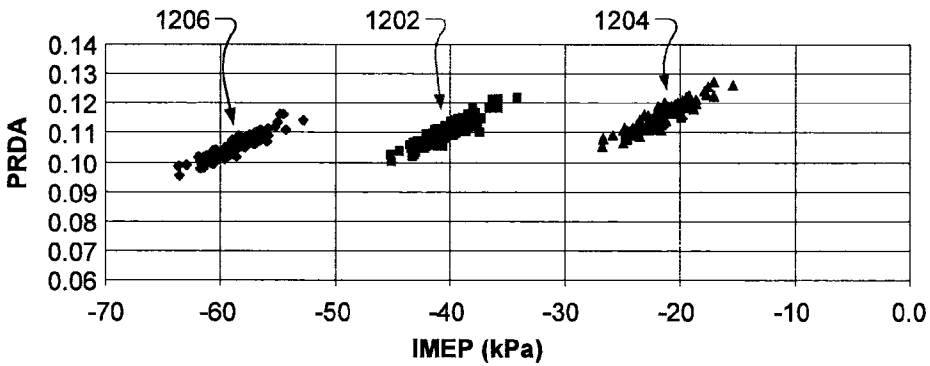
FIGS. 12A-12B are exemplary illustrations of PRDA versus IMEP and indicated mean effective pressure difference (IMEPD), respectively, according to the principles of the present disclosure.

Manufacturing and/or assembly of various components of the engine 102, such as the crankshaft and the N-toothed wheel, may cause an offset of the crankshaft. In other words, the measured crankshaft angle may be offset with respect to the actual crankshaft angle. FIG. 12A illustrates the relationship between PRDA and IMEP with various crankshaft angle offsets.

Square samples 1202, triangular samples 1204, and diamond samples 1206 correspond to samples based on a crankshaft angle offsets of 0.0 °, 0.5°, and −0.5°, respectively. As can be seen from FIG. 12A, a crankshaft angle offset on the magnitude of 0.5° may cause measurable changes in the IMEP. This measurable change may be attributable to, for example, heat loss.

Figure 12B:
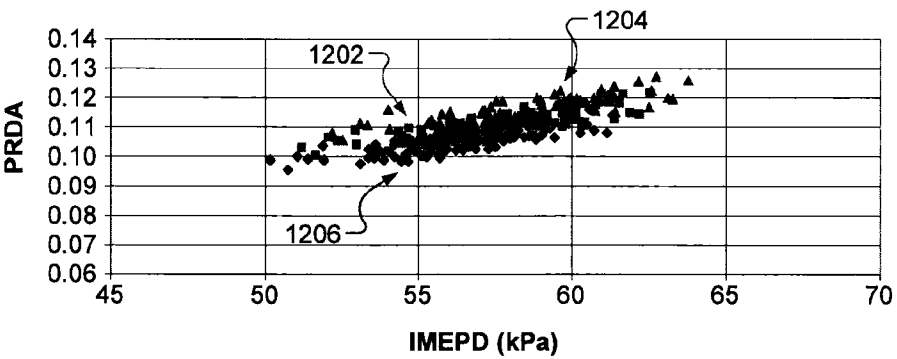

Referring now to FIG. 12B, an illustration of the relationship between PRDA and IMEPD with the crankshaft angle offsets of FIG. 12A is presented. As can be noticed from FIG. 12B, using IMEPD minimizes the effect of the crankshaft angle offset. The dispersion of the samples 1202, 1204, and 1206 when using IMEPD is reduced to less than 2.0%. Accordingly, the diagnostic module 314 may use IMEPD as an alternative to the PRDA.

Figure 13A:
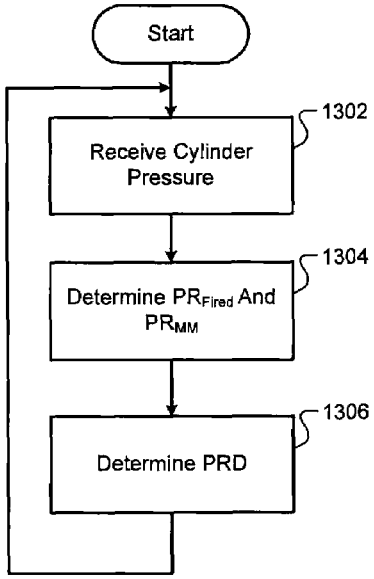
FIGS. 13A-13D are flowcharts depicting exemplary steps performed by the combustion control module according to the principles of the present disclosure.

Referring now to FIGS. 13A-13D, flowcharts depicting exemplary steps performed by the combustion control module 290 are presented. Referring specifically to FIG. 13A, control begins in step 1302 where control receives the cylinder pressure. Control receives the cylinder pressure from the cylinder pressure sensor 134.

In step 1304, control determines the fired PR and the motored measured PR. The PR at a crankshaft angle is equal to the measured cylinder pressure at the crankshaft angle divided by an expected motored cylinder pressure at the crankshaft angle. The fired PR is the PR determined based on the measured cylinder pressure when the cylinder 112 is being fired. The motored measured PR corresponds to the PR determined based on the measured cylinder pressure when the cylinder is being motored (i.e., not fired).

Control determines the PRD in step 1306. Control determines the PRD based on the difference between the fired PR and the motored PR. For example only, control may determine the PRD using equation (2), as described above. Control then returns to step 1302. The PRD may be used to adjust, for example, the combustion timing, the crankshaft angle at which various percentages of the injected fuel are combusted, and/or the MBF.

Figure 13B:
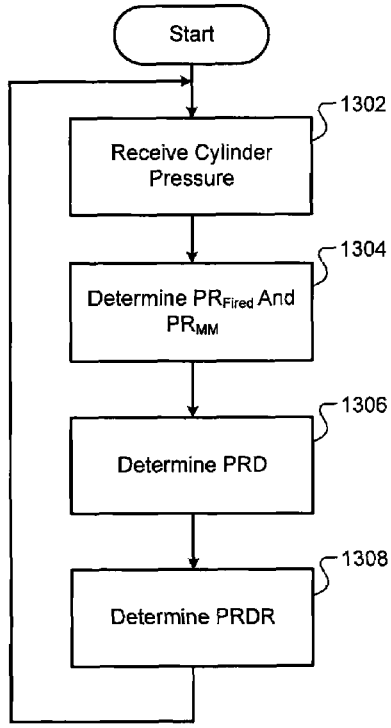

Referring now to FIG. 13B, control performs steps 1302 through 1306 similarly or identically to those of FIG. 13A. Instead of returning after step 1306, however, control determines the PRDR in step 1308. Control determines the PRDR using equations (3) or (4) as described above. Control then returns to step 1302. The PRDR may be used to determine, for example, the heat release profile, the heat release rate, and/or any other suitable parameter.

Figure 13C:
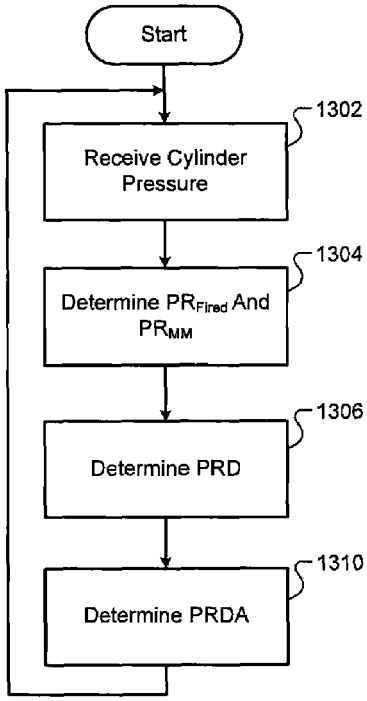

Referring now to FIG. 13C, control performs steps 1302 through 1306 similarly or identically to those of FIG. 13A. Instead of returning after step 1306, however, control determines the PRDA in step 1310. Control determines the PRDA using equation (5), as described above. Control then returns to step 1302. The PRDA may be used to, for example, determine the quantity of fuel injected, the CN for the fuel, and/or the combustion timing at which a predetermined percentage (or mass) of the injected fuel has been combusted.

Figure 13D:
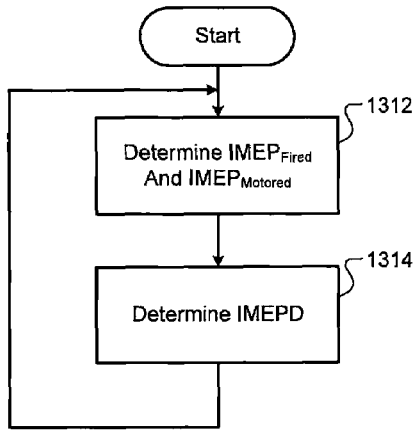

Referring now to FIG. 13D, control determines the fired IMEP and the motored IMEP in step 1312. Control determines the fired IMEP and the motored IMEP based on the crankshaft angle and the cylinder pressure using equations (6) and (7), as described above. In step 1314, control determines the IMEPD.

Control determines the IMEPD based on the fired IMEP and the motored IMEP. For example only, control determines the IMEPD using equation (8), as described above. Control then returns to step 1314. The IMEPD may be used, for example, as an alternative to the PRDA. In other words, control may use the IMEPD to diagnose, for example, the quantity of fuel injected, the CN of the fuel, and/or the crankshaft timing at which a predetermined percentage (or mass) of the injected fuel has been combusted.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A combustion control system for a vehicle, comprising:

a pressure ratio (PR) module that determines fired PR values and measured motored PR values based on cylinder pressures measured by a cylinder pressure sensor when a cylinder of an engine is fired and motored, respectively;

a pressure ratio difference (PRD) module that determines PRD values for predetermined crankshaft angles, wherein each of said PRD values is determined based on one of said fired PR values and one of said measured motored PR values at one of said predetermined crankshaft angles; and a pressure ratio difference rate (PRDR) module that determines and outputs a PRDR value based on a rate of change of said PRD values over a range of said predetermined crankshaft angles.

2. The combustion control system of claim 1 wherein said PRD module determines a first PRD value and a second PRD value for a first one and a second one of said predetermined crankshaft angles, respectively, wherein said PRDR module determines said PRDR value based on a difference between said first and second PRD values, and wherein said range is defined by said first and second ones of said predetermined crankshaft angles.

3. The combustion control system of claim 1 further comprising a heat release profile module that determines a heat release profile for fuel provided to said cylinder based on said PRDR value.

4. The combustion control system of claim 3 further comprising a timing control module that adjusts a combustion timing for said cylinder based on said heat release profile.

5. The combustion control system of claim 4 wherein said combustion timing comprises a fuel injection timing.

6. The combustion control system of claim 1 wherein said PRDR module determines said PRDR value further based on a combustion timing and an EGR valve opening.

7. The combustion control system of claim 1 further comprising at least one of:

a pressure ratio difference average (PRDA) module that determines a PRDA value based on an average of a number of said PRD values; and an indicated mean effective pressure difference (IMEPD) module that determines an IMEPD value based on a fired indicated mean effective pressure (IMEP) value and a motored IMEP value for said cylinder.

8. The combustion control system of claim 7 further comprising a diagnostic module that diagnoses at least one of a quantity of fuel provided to said cylinder, a cetane number (CN) for said fuel, and a crankshaft angle at which a predetermined amount of said fuel was combusted within said cylinder based on at least one of said PRDA value and said IMEPD value.

9. A combustion control system for a vehicle, comprising:

an indicated mean effective pressure (IMEP) module that determines fired IMEP values and motored IMEP values based on cylinder pressures measured by a cylinder pressure sensor when a cylinder of an engine is fired and motored, respectively; and an indicated mean effective pressure difference (IMEPD) module that determines and outputs an IMEPD value based on a difference between one of said fired IMEP values and one of said motored IMEP values.

10. The combustion control system of claim 9 further comprising a diagnostic module that diagnoses at least one of a quantity of fuel provided to said cylinder, a cetane number (CN) for said fuel, and a crankshaft angle at which a predetermined amount of said fuel was combusted within said cylinder based on said IMEPD value.

11. The combustion control system of claim 10 further comprising:

a pressure ratio (PR) module that determines fired PR values and measured motored PR values based on said cylinder pressures;

a pressure ratio difference (PRD) module that determines PRD values for predetermined crankshaft angles, wherein each of said PRD values is determined based on one of said fired PR values and one of said measured motored PR values at one of said predetermined crankshaft angles; and a pressure ratio difference rate (PRDR) module that determines and outputs a PRDR value based on a rate of change of said PRD values over a range of said predetermined crankshaft angles.

12. The combustion control system of claim 11 wherein said PRD module determines a first PRD value and a second PRD value for a first one and second one of said predetermined crankshaft angles, respectively, wherein said PRDR module determines said PRDR value based on a difference between said first and second PRDs, and wherein said range is defined by said first and second ones of said predetermined crankshaft angles.

13. The combustion control system of claim 11 further comprising a heat release profile module that determines a heat release profile for fuel provided to said cylinder based on said PRDR value.

14. The combustion control system of claim 13 further comprising a timing control module that adjusts a combustion timing for said cylinder based on said heat release profile.

15. A method for a vehicle, comprising:

determining fired pressure ratio (PR) values and measured motored PR values based on cylinder pressures measured by a cylinder pressure sensor when a cylinder of an engine is fired and motored, respectively;

determining pressure ratio difference (PRD) values for predetermined crankshaft angles, wherein each of said PRD values is determined based on one of said fired PR values and one of said measured motored PR values at one of said predetermined crankshaft angles;

determining a pressure ratio difference rate (PRDR) value based on a rate of change of said PRD values over a range of said predetermined crankshaft angles; and outputting said PRDR value.

16. The method of claim 15 wherein said determining said PRD values comprises determining a first PRD value and a second PRD value for a first one and a second one of said predetermined crankshaft angles, respectively, wherein said determining said PRDR value comprises determining said PRDR value based on a difference between said first and second PRD values, and wherein said range is defined by said first and second ones of said predetermined crankshaft angles.

17. The method of claim 15 further comprising determining a heat release profile for fuel provided to said cylinder based on said PRDR value.

18. The method of claim 17 further comprising adjusting a combustion timing for said cylinder based on said heat release profile.

19. The method of claim 18 wherein said adjusting said combustion timing comprises adjusting a fuel injection timing.

20. The method of claim 15 wherein said determining said PRDR value comprises determining said PRDR value further based on a combustion timing and an EGR valve opening.

21. The method of claim 15 further comprising at least one of:

determining a pressure ratio difference average (PRDA) value based on an average of a number of said PRD values; and determining an indicated mean effective pressure difference (IMEPD) value based on a fired indicated mean effective pressure (IMEP) value and a motored IMEP value for said cylinder.

22. The method of claim 21 further comprising diagnosing at least one of a quantity of fuel provided to said cylinder, a cetane number (CN) for said fuel, and a crankshaft angle at which a predetermined amount of said fuel was combusted within said cylinder based on at least one of said PRDA value and said IMEPD value.

23. A method for a vehicle, comprising:

determining fired indicated mean effective pressure (IMEP) values and motored IMEP values based on cylinder pressures measured by a cylinder pressure sensor when a cylinder of an engine is fired and motored, respectively; and determining an indicated mean effective pressure difference (IMEPD) value based on a difference between one of said fired IMEP values and one of said motored IMEP values.

24. The method of claim 23 further comprising diagnosing at least one of a quantity of fuel provided to said cylinder, a cetane number (CN) for said fuel, and a crankshaft angle at which a predetermined amount of said fuel was combusted within said cylinder based on said IMEPD value.

25. The method of claim 24 further comprising:

determining fired pressure ratio (PR) values and measured motored PR values based on said cylinder pressures;

determining pressure ratio difference (PRD) values for predetermined crankshaft angles, wherein each of said PRD values is determined based on one of said fired PR values and one of said measured motored PR values at one of said predetermined crankshaft angles;

determining a pressure ratio difference rate (PRDR) value based on a rate of change of said PRD values over a range of said predetermined crankshaft angles; and outputting said PRDR value.

26. The method of claim 25 wherein said determining said PRD values comprises determining a first PRD value and a second PRD value for a first one and a second one of said predetermined crankshaft angles, respectively, wherein said determining said PRDR value comprises determining said PRDR value based on a difference between said first and second PRD values, and wherein said range is defined by said first and second ones of said predetermined crankshaft angles.

27. The method of claim 25 further comprising determining a heat release profile for fuel provided to said cylinder based on said PRDR value.

28. The method of claim 27 further comprising adjusting a combustion timing for said cylinder based on said heat release profile.

* * * * *